US007307592B2

(12) United States Patent
Park et al.

(10) Patent No.: US 7,307,592 B2
(45) Date of Patent: Dec. 11, 2007

(54) MOBILE COMMUNICATION TERMINAL HAVING ELECTROSTATIC DISCHARGE PROTECTION FUNCTION

(75) Inventors: Book-sung Park, Seoul (KR); Eun-tae Kim, Seoul (KR)

(73) Assignee: Pantech & Curitel Communications, Inc. (KR)

( * ) Notice: Subject to any disclaimer, the term of this patent is extended or adjusted under 35 U.S.C. 154(b) by 108 days.

(21) Appl. No.: 11/361,183

(22) Filed: Feb. 24, 2006

(65) Prior Publication Data

US 2007/0046550 A1 Mar. 1, 2007

(30) Foreign Application Priority Data

Sep. 1, 2005 (KR) ..... 10-2005-0081446

(51) Int. Cl.
*H01Q 1/24* (2006.01)

(52) U.S. Cl. ..... 343/702; 343/718; 343/895

(58) Field of Classification Search ..... 343/702, 343/718, 846, 895; 257/355–356
See application file for complete search history.

(56) References Cited

U.S. PATENT DOCUMENTS 5,280,646 A 1/1994 Koyama et al.
5,503,059 A * 4/1996 Pacholok ..... 89/1.11
6,445,039 B1 * 9/2002 Woo et al. ..... 257/355

FOREIGN PATENT DOCUMENTS

| | | |
|---|---|---|
| EP | 0 367 225 | 5/1990 |
| JP | 56-153805 | 11/1981 |
| JP | 2000-312108 | 11/2000 |
| KR | 10-2005-0041470 | 5/2005 |
| WO | WO 2004/045019 | 5/2004 |

* cited by examiner

*Primary Examiner*—Douglas W. Owens
*Assistant Examiner*—Chuc Tran
(74) *Attorney, Agent, or Firm*—Blakely, Sokoloff, Taylor & Zafman

(57) ABSTRACT

Disclosed is a mobile communication terminal having an ESD (electrostatic discharge) protection function that includes a multi-band intenna including: a main signal pattern line that transmits/receives a main frequency band signal and is formed in a meander-line shape; at least one sub signal pattern line that is formed unitarily with the main signal pattern line and transmits/receives a frequency band signal different from that of the main signal pattern line; a discharge pattern line that is provided between the main and sub signal pattern lines to form a spark gap and performs an ESD protection function; a feed point that is formed on the main signal pattern line for power feeding; and a shorting point that is formed on the discharge pattern line to discharge static electricity to a ground terminal.

25 Claims, 6 Drawing Sheets

FIG.3

| FREQUENCY(GHz) | 0.85 | 0.9 | 1.5 | 1.8 | 1.9 | 2.1 |
|---|---|---|---|---|---|---|
| RESISTIVITY (MICRO-OHM -CENTIMETERS) | 1.59 | 1.59 | 1.59 | 1.59 | 1.59 | 1.59 |
| RELATIVE PERMEABILITY | 1.00 | 1.00 | 1.00 | 1.00 | 1.00 | 1.00 |
| CONDUCTIVITY (MHOS/M) | 62,893,081.76 | 62,893,081.76 | 62,893,081.76 | 62,893,081.76 | 62,893,081.76 | 62,893,081.76 |
| SKIN DEPTH (MICRO INCHES) | 85.70 | 83.28 | 64.51 | 58.89 | 57.32 | 54.52 |
| SKIN DEPTH (MICRO METERS) | 2.18 | 2.12 | 1.64 | 1.50 | 1.46 | 1.30 |
| SPUTTERING THICKNESS 10.000 Å=1UM | 21,800Å | 21,200Å | 16,400Å | 15,000Å | 14,600Å | 13,000Å |

MOBILE COMMUNICATION TERMINAL HAVING ELECTROSTATIC DISCHARGE PROTECTION FUNCTION

BACKGROUND OF THE INVENTION

This application claims the priority of Korean Patent Application No. 2005-81446, filed on Sep. 1, 2005, in the Korean Intellectual Property Office, the disclosure of which is incorporated herein in its entirety by reference.

1. Field of the Invention

The present invention relates to a mobile communication terminal having an electrostatic discharge (ESD) protection function and, more particularly, to an antenna embedded in the mobile communication terminal.

2. Description of Related Art

In general, a mobile communication terminal has employed a whip antenna or a stubby antenna. Recently, the mobile communication terminal is increasingly employing an embedded antenna, i.e., intenna, for the sake of miniaturization. Further, it may employ both external and embedded antennas.

Examples of the embedded antenna include a multi-band monopole antenna, which radiates uniformly in all directions when viewed from above, and a planar inverted F antenna (PIFA), which is a variation of the monopole antenna.

However, since the conventional antenna is mounted in a finished state on the mobile communication terminal, there is a limitation of space required for providing the antenna.

According to the present invention, there is provided an intenna that is deposited on a front or back case of the mobile communication terminal by a sputtering method. Accordingly, it is possible to overcome a limitation of space required for providing the intenna and to improve the performance of the intenna formed on the front or back case of the mobile communication terminal.

SUMMARY OF THE INVENTION

The present invention provides a mobile communication terminal that improves the performance of an intenna embedded in the mobile communication terminal and has an electrostatic discharge (ESD) protection function.

According to an aspect of the present invention, there is provided a mobile communication terminal having an ESD (electrostatic discharge) protection function that includes a multi-band intenna including: a main signal pattern line that transmits/receives a main frequency band signal and is formed in a meander-line shape; at least one sub signal pattern line that is formed unitarily with the main signal pattern line and transmits/receives a frequency band signal different from that of the main signal pattern line; a discharge pattern line that is provided between the main and sub signal pattern lines to form a spark gap and performs an ESD protection function; a feed point that is formed on the main signal pattern line for power feeding; and a shorting point that is formed on the discharge pattern line to discharge static electricity to a ground terminal.

The discharge pattern line may include a triangular branch pattern disposed at a position facing an end portion of the main signal pattern line and/or the sub signal pattern line.

The main signal pattern line may include a plurality of square branch patterns at positions facing the discharge pattern line.

The discharge pattern line may further include triangular branch patterns at positions facing the square branch patterns formed on the main signal pattern line.

The discharge pattern line may further include a case grounding part that is connected to a front case or back case of the mobile communication terminal.

At least one of the main and sub signal pattern lines may further include a triangular branch pattern at its end portion.

The triangular branch pattern may be a tape antenna for tuning.

The feed point may be a screw hole for connection of a pogo pin for connecting the main and sub signal pattern lines to a PCB (printed circuit board).

The shorting point may be a screw hole for connection of a pogo pin for connecting the discharge pattern line to a grounding plane.

BRIEF DESCRIPTION OF THE DRAWINGS

The above and other features and advantages of the present invention will become more apparent by describing in detail exemplary embodiments thereof with reference to the attached drawings in which:

FIG. 3 is a table for showing skin depth based on the frequency of signal and the resistivity of intenna.

DETAILED DESCRIPTION OF THE INVENTION

Exemplary embodiments in accordance with the present invention will now be described in detail with reference to the accompanying drawings.

Figure 1:
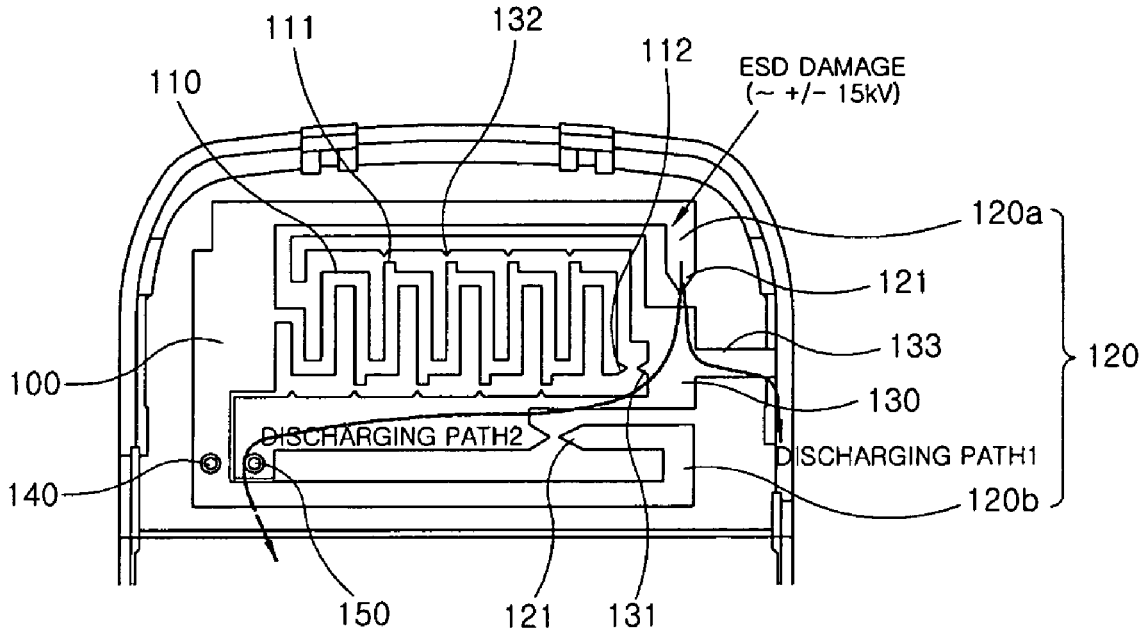
FIG. 1 is a mobile communication terminal having an ESD protection function according to an embodiment of the present invention.

FIG. 1 is a mobile communication terminal having an electrostatic discharge (ESD) protection function according to an embodiment of the present invention. The mobile communication terminal includes a triple-band intenna.

The intenna 100 includes a main signal pattern line 110, a sub signal pattern line 120, a discharge pattern line 130, a feed point 140, and a shorting point 150.

The main signal pattern line 110 transmits/receives main frequency band signals, e.g., GSM/DCS/PCS signals, and has a meander-line structure.

The sub signal pattern line 120 is formed unitarily with the main signal pattern line 110 and transmits/receives frequency band signals different from the main frequency band signals.

For example, the sub signal pattern line 120 includes a first sub signal pattern line part 120*a* for transmitting/receiving WCDMA signals and a second sub signal pattern line part 120*b* for transmitting/receiving GPS signals.

The discharge pattern line 130 is provided between the main and sub signal pattern lines 110 and 120 to form a spark gap therebetween, thereby performing an ESD protection function.

Electrostatic electricity means the surplus or insufficient static charges on the surface of an object, and it is a result that positive/negative charges lose balance within a local scope. Electrostatic electricity is formed through the transfer of electrons or ions. It is a kind of electrical energy staying on the surface. An electrostatic field is generated around the object which is charged with static electricity. The electrostatic field strength is proportional to the amount of static electricity stored in the object. However, when the electrostatic field strength reaches the dielectric breakdown strength of air (about 30 kV/cm), the discharge occurs.

For example, when static electricity built up on an antenna reaches the dielectric breakdown strength of air and the discharge occurs, there is a probability that a transceiver or a baseband chip of a mobile communication terminal gets damaged.

According to the present invention, since the discharge pattern line 130 is provided between the main signal pattern line 110 and the sub signal pattern line 120 and the spark gap is formed therebetween so that the static electricity generated in the main signal pattern line 110 and the sub signal pattern line 120 can be discharged through the discharge pattern line 130, it is possible to improve the performance of the intenna embedded in the mobile communication terminal and to protect the mobile communication terminal from electrostatic discharge.

The feed point 140 is formed on the main signal pattern line 110 for power feeding.

That is, the feed point 140 is a connecting part for power feeding purpose. For example, the feed point 140 may be a screw hole for connection of a pogo pin for connecting the main and sub signal pattern lines 110 and 120 to a printed circuit board (PCB).

The shorting point 150 is formed on the discharge pattern line 130 to discharge the static electricity to a ground terminal.

That is, the shorting point 150, which is a connecting part for discharging purpose, discharges the static electricity, which is induced from the main and sub signal pattern lines 110 and 120 to the discharge pattern line 130, to the ground terminal.

The shorting point 150 may be a screw hole for connection of a pogo pin for connecting the discharge pattern line 130 to the ground terminal.

According to the present invention, since the static electricity generated in the main and sub signal pattern lines 110 and 120 of the intenna 100 embedded in the mobile communication terminal can be discharged through the discharge pattern line 130 before reaching the dielectric breakdown strength of air (about 30 KV/cm), it is possible to improve the performance of the intenna embedded in the mobile communication terminal and to protect the mobile communication terminal from electrostatic discharge.

The discharge pattern line 130 may include a triangular branch pattern 131 disposed at a position facing an end portion of the main signal pattern line 110 and/or the sub signal pattern line 120.

That is, the triangular branch pattern 131 acts like a lightning rod, such that the static electricity formed on the main signal pattern line 110 and/or the sub signal pattern line 130 is discharged to the discharge pattern line 130 through the triangular branch pattern 131. Accordingly, it is possible to improve the performance of the intenna embedded in the mobile communication terminal and to protect the mobile communication terminal from electrostatic discharge.

The main signal pattern line 110 may include a plurality of square branch patterns 111 disposed at positions facing the discharge pattern line 130.

The discharge pattern line 130 may further include a plurality of triangular branch patterns 132 disposed at positions facing the square branch patterns 111 formed on the main signal pattern line 110.

Accordingly, the spark gaps between the square branch patterns 111 and the triangular branch patterns 132 are narrowed down, such that the static electricity is collectively discharged through the spark gap from the main signal pattern line 110 into the discharge pattern line 130.

The discharge pattern line 130 may further include a case grounding part 133, which is connected to a front case or a back case of the mobile communication terminal.

That is, the case grounding part 133 forms another path for discharging the static electricity formed on the main signal pattern line and/or the sub signal pattern line to the ground terminal.

Accordingly, since the static electricity collected from the main signal pattern line 110 and/or the sub signal pattern line 120 into the discharge pattern line 130 is discharged to the ground terminal through two paths, i.e., the shorting point 150 and the case grounding part 133, it is possible to improve the performance of the intenna embedded in the mobile communication terminal and to protect the mobile communication terminal from electrostatic discharge.

At least one of the main and sub signal pattern lines 110 and 120 may further include a triangular branch pattern 112, 121 at its end portion.

In this case, the triangular branch pattern 112, 121 may be a tape antenna for tuning purpose, which is formed of a thin film to provide better radiation performance.

Accordingly, it is possible to improve the performance of the intenna embedded in the mobile communication terminal, and to provide the mobile communication terminal having an ESD protection function.

Figure 2:
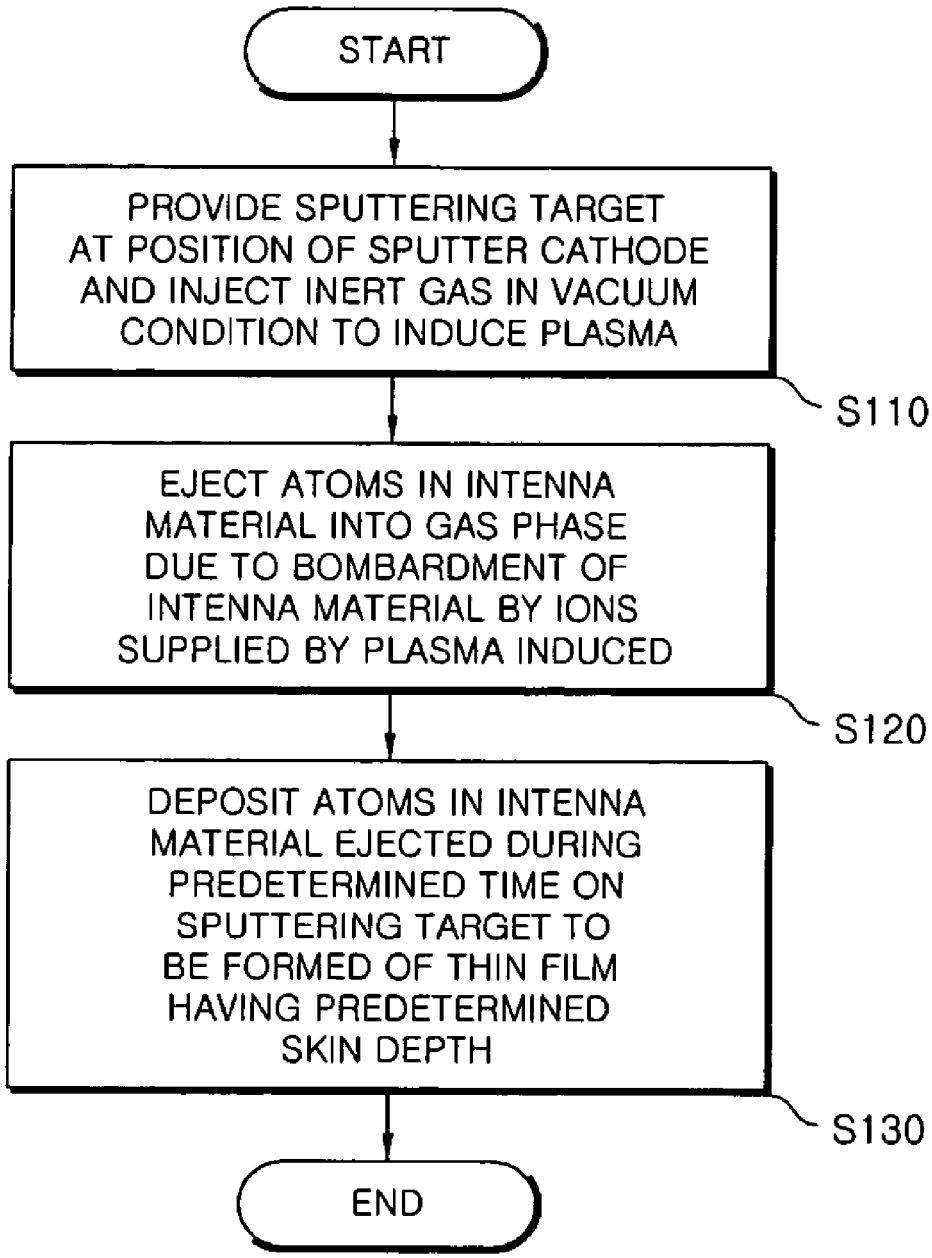
FIG. 2 is a flow chart of a method of forming an intenna embedded in a mobile communication terminal having an ESD protection function according to an embodiment of the present invention.

FIG. 2 is a flow chart of a method of forming the intenna embedded in the mobile communication terminal that has an ESD protection function.

The intenna embedded in the mobile communication terminal having an ESD protection function according to an embodiment of the present invention is formed through deposition performed on a front or back case of the mobile communication terminal by a sputtering method. Accordingly, it is possible to overcome a limitation in space required for providing the conventional intenna that is embedded in the mobile communication terminal.

The sputtering method is a physical process whereby atoms in a solid target material are ejected into the gas phase due to bombardment of the material by energetic ions. It is commonly used for thin-film deposition.

In operation S110, a sputtering target is provided at a position of a sputter cathode, and an inert gas is injected in a vacuum condition to induce a plasma.

The plasma is an ionized gas. "Ionized" in this case means that at least one electron has been removed from a significant fraction of the molecules. The free electric charges make the plasma electrically conductive so that it couples strongly to electromagnetic fields.

That is, in operation S110, the sputtering target, i.e., the front or back case of the mobile communication terminal, is provided at a position of the sputter cathode, and the inert gas is injected in a vacuum condition to induce a plasma.

In operation S120, atoms in an intenna material are ejected into the gas phase due to bombardment of the intenna material by the ions supplied by the plasma that is induced in the operation S110.

That is, in operation S120, the atoms in the intenna material, such as silver (Ag), stainless steel (SUS), or bronze, are ejected into the gas phase due to bombardment of the intenna material by the ions having positive charges which are supplied by the plasma induced in the operation S110.

In operation S130, the atoms in the intenna material which are ejected during a predetermined time in operation S120 are deposited on the sputtering target to be formed of a thin film having a predetermined skin depth. In this case, the deposited intenna preferably has a shape shown in FIG. 1, but may be formed in various shapes.

That is, in operation S130, the atoms in the intenna material which are ejected during a predetermined time in operation S120 are deposited on the sputtering target, i.e., the front or back case of the mobile communication terminal, to be formed of a thin film having a predetermined skin depth.

The term "skin depth" implies the effective depth of penetration of an electromagnetic wave in a conductive medium. The skin depth is the distance in which the wave decays to 1/e (about 37%) of its value.

It can be expressed as:

$$\delta = \sqrt{\frac{2\rho}{2\pi f \mu_R \mu_0}} \qquad \text{[Equation 1]}$$

δ: skin depth

ρ: resistivity of intenna f: frequency of signal transmitted/received through intenna $\mu_R$: relative permeability $\mu_0$: conductivity FIG. 3 is a table for showing the skin depth based on the frequency of signal and the resistivity of intenna. The intenna is deposited on a surface of the sputtering target to be formed of a thin film having a proper skin depth based on the characteristic of the intenna.

According to the method of forming the intenna by the sputtering method, a planar inverted F antenna (PIFA), which uses a ground line and a signal line upon power supplying, and a multi-band monopole antenna, which has no plane for grounding, can be deposited on an inner surface of the front or back case of the mobile communication terminal. Accordingly, it is possible to overcome a limitation in an inner space of the mobile communication terminal that is caused by mounting the conventional intenna in a finished state on the mobile communication terminal.

Figure 4A:
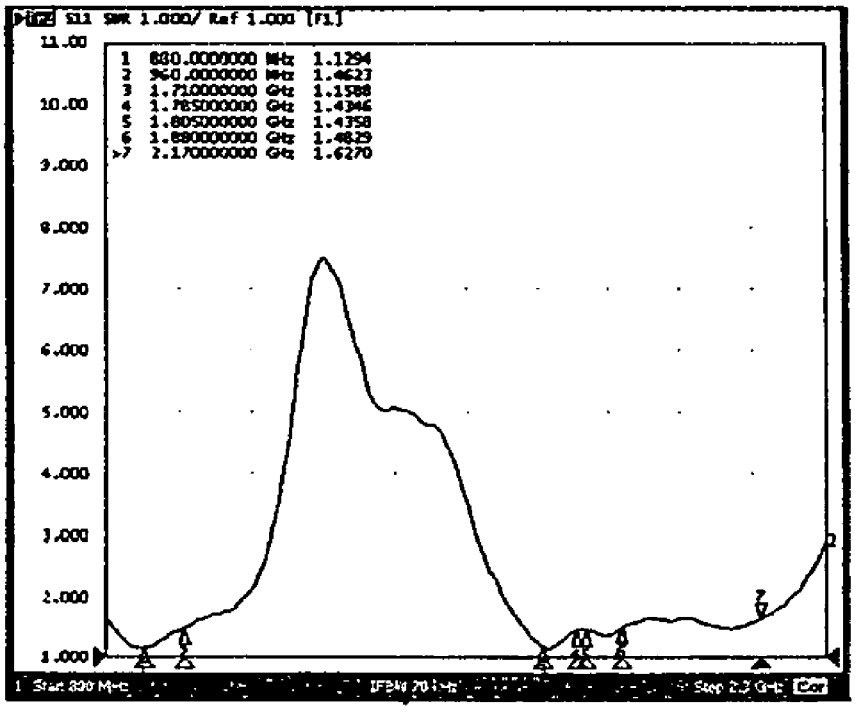
FIGS. 4A to 4C are characteristic graphs of antennas.
Figure 4B:
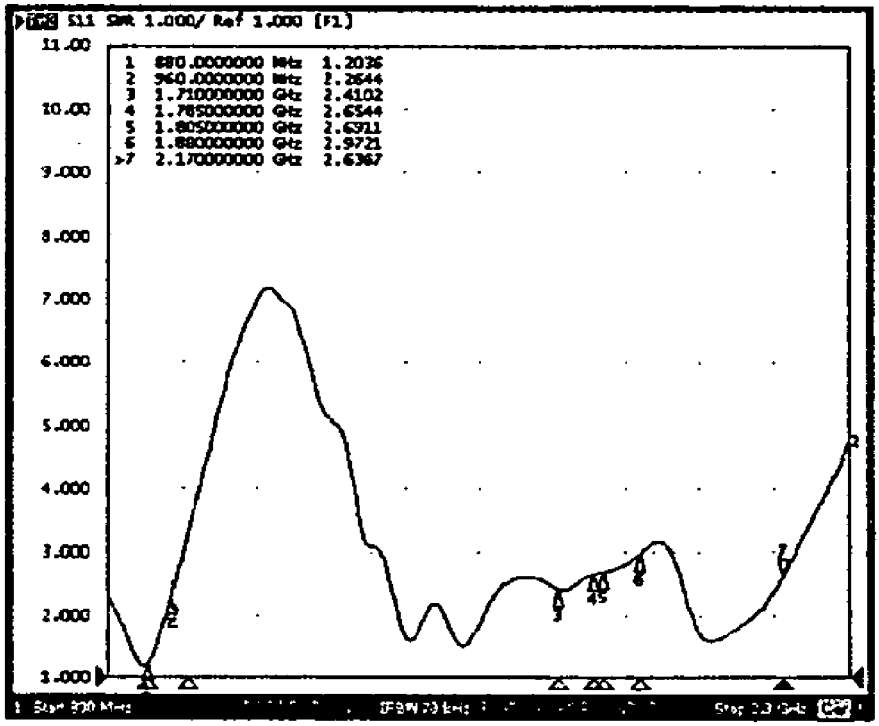
Figure 4C:
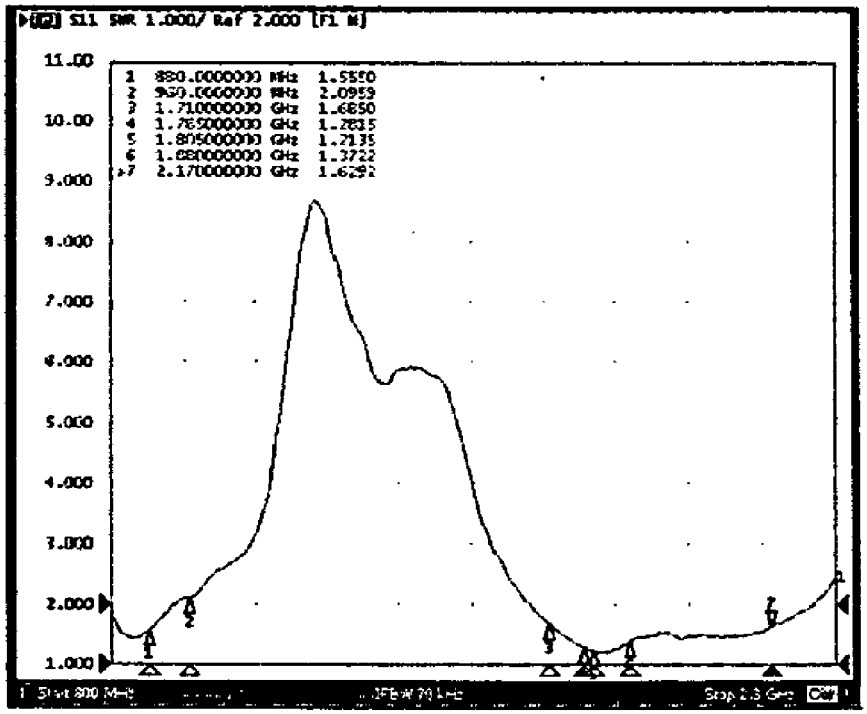

FIG. 4A is a characteristic graph of a conventional multi-band monopole intenna mounted in a finished state on a mobile communication terminal. FIG. 4B is a characteristic graph of the intenna according to the embodiment shown in FIG. 1. FIG. 4C is a characteristic graph of the intenna shown in FIG. 4B, in which the intenna is tuned.

In FIG. 4A, the standing wave ratio (SWR), which implies the ratio of maximum voltage (current) and minimum voltage (current), is 1.6:1 in GSM band, 1.6:1 in DCS band, 1.6:1 in PCS band, and 1.8:1 in WCDMA band. In FIG. 4B, the SWR is 2.5:1 in GSM band, 2.8:1 in DCS band, 3.0:1 in PCS band, and 2.8:1 in WCDMA band. However, in FIG. 4C, the SWR is 2.1:1 in GSM band, 2.0:1 in DCS band, 2.0:1 in PCS band, and 2.0:1 in WCDMA band. Accordingly, the intenna according to the present invention has a function similar to that of the conventional intenna and overcomes a limitation in space that is caused by mounting the conventional intenna in a finished state on the mobile communication terminal.

As apparent from the above description, the mobile communication terminal having an ESD protection function according to the present invention can be protected from ESD that occurs in the intenna formed on a front or back case of the mobile communication terminal. Accordingly, it is possible to improve the performance of the intenna embedded in the mobile communication terminal and to protect the mobile communication terminal from the ESD.

While the present invention has been described with reference to exemplary embodiments thereof, it will be understood by those skilled in the art that various changes in form and details may be made therein without departing from the scope of the present invention as defined by the following claims.

What is claimed is:

1. A mobile communication terminal having an ESD (electrostatic discharge) protection function that includes a multi-band intenna comprising:

a main signal pattern line that transmits/receives a main frequency band signal and is formed in a meander-line shape;

at least one sub signal pattern line that is formed unitarily with the main signal pattern line and transmits/receives a frequency band signal different from that of the main signal pattern line;

a discharge pattern line that is provided between the main and sub signal pattern lines to form a spark gap and performs an ESD protection function;

a feed point that is formed on the main signal pattern line for power feeding; and a shorting point that is formed on the discharge pattern line to discharge static electricity to a ground terminal.

2. The mobile communication terminal of claim 1, wherein the discharge pattern line includes a triangular branch pattern disposed at a position facing an end portion of the main signal pattern line and/or the sub signal pattern line.

3. The mobile communication terminal of claim 2, wherein the main signal pattern line includes a plurality of square branch patterns at positions facing the discharge pattern line.

4. The mobile communication terminal of claim 3, wherein the discharge pattern line further includes triangular branch patterns at positions facing the square branch patterns formed on the main signal pattern line.

5. The mobile communication terminal of claim 4, wherein the discharge pattern line further includes a case grounding part that is connected to a front case or back case of the mobile communication terminal.

6. The mobile communication terminal of claim 1, wherein at least one of the main and sub signal pattern lines further includes a triangular branch pattern at its end portion.

7. The mobile communication terminal of claim 2, wherein at least one of the main and sub signal pattern lines further includes a triangular branch pattern at its end portion.

8. The mobile communication terminal of claim 3, wherein at least one of the main and sub signal pattern lines further includes a triangular branch pattern at its end portion.

9. The mobile communication terminal of claim 4, wherein at least one of the main and sub signal pattern lines further includes a triangular branch pattern at its end portion.

10. The mobile communication terminal of claim 5, wherein at least one of the main and sub signal pattern lines further includes a triangular branch pattern at its end portion.

11. The mobile communication terminal of claim 6, wherein the triangular branch pattern is a tape antenna for tuning.

12. The mobile communication terminal of claim 7, wherein the triangular branch pattern is a tape antenna for tuning.

13. The mobile communication terminal of claim 8, wherein the triangular branch pattern is a tape antenna for tuning.

14. The mobile communication terminal of claim 9, wherein the triangular branch pattern is a tape antenna for tuning.

15. The mobile communication terminal of claim 10, wherein the triangular branch pattern is a tape antenna for tuning.

16. The mobile communication terminal of claim 1, wherein the feed point is a screw hole for connection of a pogo pin for connecting the main and sub signal pattern lines to a PCB (printed circuit board).

17. The mobile communication terminal of claim 2, wherein the feed point is a screw hole for connection of a pogo pin for connecting the main and sub signal pattern lines to a PCB.

18. The mobile communication terminal of claim 3, wherein the feed point is a screw hole for connection of a pogo pin for connecting the main and sub signal pattern lines to a PCB.

19. The mobile communication terminal of claim 4, wherein the feed point is a screw hole for connection of a pogo pin for connecting the main and sub signal pattern lines to a PCB.

20. The mobile communication terminal of claim 5, wherein the feed point is a screw hole for connection of a pogo pin for connecting the main and sub signal pattern lines to a PCB.

21. The mobile communication terminal of claim 1, wherein the shorting point is a screw hole for connection of a pogo pin for connecting the discharge pattern line to a grounding plane.

22. The mobile communication terminal of claim 2, wherein the shorting point is a screw hole for connection of a pogo pin for connecting the discharge pattern line to a grounding plane.

23. The mobile communication terminal of claim 3, wherein the shorting point is a screw hole for connection of a pogo pin for connecting the discharge pattern line to a grounding plane.

24. The mobile communication terminal of claim 4, wherein the shorting point is a screw hole for connection of a pogo pin for connecting the discharge pattern line to a grounding plane.

25. The mobile communication terminal of claim 5, wherein the shorting point is a screw hole for connection of a pogo pin for connecting the discharge pattern line to a grounding plane.

* * * * *